US005988917A

United States Patent [19]

Sheffler et al.

[11] Patent Number: 5,988,917

[45] Date of Patent: Nov. 23, 1999

[54] COSMETIC STICK DISPENSER

[75] Inventors: Robert J. Sheffler, Morganville, N.J.; Charles Chang, 55 Westview Rd., Wayne, N.J. 07470

[73] Assignee: Charles Chang, Wayne, N.J.

[21] Appl. No.: 09/173,266

[22] Filed: Oct. 15, 1998

[51] Int. Cl.[6] ..... B43K 21/08

[52] U.S. Cl. ..... 401/78; 401/68; 401/77

[58] Field of Search ..... 401/78, 55, 62, 401/68, 69, 77, 86, 87

[56] References Cited

U.S. PATENT DOCUMENTS

| | | | |
|---|---|---|---|
| 2,529,673 | 11/1950 | Blake | 401/78 |
| 3,380,795 | 4/1968 | Gruska | 401/78 |
| 4,991,987 | 2/1991 | Holloway et al. | 401/78 |
| 5,186,561 | 2/1993 | Ackermann et al. | 401/78 |

*Primary Examiner*—David J. Walczak

*Attorney, Agent, or Firm*—H. Gibner Lehmann; K. Gibner Lehmann

[57] ABSTRACT

A cosmetic dispenser containing an elevator cup carrying a solid cosmetic product, a sleeve in which the cup is axially advanceable and retractable, and an operating shell turnably mounted on the sleeve. The sleeve has either two or else three equispaced longitudinal slots and the elevator cup has two or else three equispaced lugs passing through and projecting from the slots of the sleeve. The operating shell has two or else three internal spiral tracks respectively engaged by the lugs of the cup to propel the latter in response to relative turning between the shell and sleeve. The arrangement is such that the cup is advanced and retracted by balanced forces applied at uniformly spaced circumferential locations about the cup. The cup has resilient fingers that are forced inward by the sleeve, forming a collet which firmly holds the lipstick pomade. The sleeve has a lateral spur track which holds the cup captive in the sleeve. Reduced tendency for undesirable tilting of the cosmetic stick product is thus realizeable.

17 Claims, 6 Drawing Sheets

COSMETIC STICK DISPENSER

NO CROSS REFERENCES TO RELATED APPLICATIONS

STATEMENT AS TO RIGHTS TO INVENTIONS MADE UNDER FEDERALLY-SPONSORED RESEARCH AND DEVELOPMENT

Research and development of the present invention and application have not been Federally-sponsored, and no rights are given under any Federal program.

BACKGROUND OF THE INVENTION

1. Field of the Invention

This invention relates generally to cosmetic dispensers, and more particularly to dispensers of the type intended for use with lipsticks, eye shadow devices, and the like.

2. Description of the Related Art Including Information Disclosed Under 37 CFR §§1.97–1.99

The following references are hereby cited as being representative of some of the known prior art in the field to which the present invention pertains:

U.S. Pat. Nos.:

2,336,328 2,497,950 2,678,128

2,796,873 3,214,012 3,443,874

Canadian Patent No. 612,457.

British Patent No. 1,098,773 and British Published Application No. GB 2,143,212A.

French Patents Nos. 946,797; 964,930; 77 32291; 1,052,053; and 2,406,972.

Italian Patent No. 507,719.

British Published Application No. GB 2,143,212A discloses a cosmetic stick holder construction utilizing a product-carrying cup having spacer portions (26) formed by slits in the upper edge of the cup in three places, the spacer portions each bearing radially outwardly on the inner sleeve of the dispenser in an elastic manner so as to purportedly minimize looseness of the cosmetic stick during its movement inside the sleeve.

British Patent No. 1,098,773 relates to a cosmetic dispenser having a product-carrying cup that employs four circumferentially displaced spacers (14) to slidingly engage the inner surface of an inner casing, for guiding of the product-carrying cup therein.

French Patent No. 77 32291 discloses a lipstick dispenser having a container, an outer sleeve, and a product cup. The product cup has two diametrically disposed camming lugs which are received in corresponding longitudinal slots in the container, and which respectively extend into two interior spiral or helical grooves in the outer sleeve.

Other lipstick dispensers utilizing turnable outer sleeves having internal spiral grooves are shown in French Patent No. 1,052,053; French Patent No. 946,797; and French Patent No. 964,930. Nos. '053 and '930 have a single groove, whereas No. '797 shows two grooves that are diametrically opposed to one another.

U.S. Pat. Nos. 2,678,128; 3,214,012; 2,497,950; Italian Patent No. 507,719; and Canadian Patent No. 612,457 show various types of lipstick refill cartridges that have been proposed in the past, but which are considered to have realized little or no commercialization in the marketplace.

Still other proposed arrangements include that of U.S. Pat. No. 3,443,874, which discloses a cosmetic stick holder and method of manufacture thereof; and U.S. Pat. No. 2,796,873, which sets forth a combined holder for lipstick, rouge, and eyeliner, the lipstick being advanceable in the casing in a linear direction by means of an external finger-engageable tab.

Finally, U.S. Pat. No. 2,336,328 illustrates a dispenser that employs a product-carrying cup which is advanceable and retractable by an internal screw that is engaged by a manually-operable thumbwheel axially mounted in the casing in such a manner that it is accessible from the side thereof.

Although various attempts have been made to provide an economical dispenser which was characterized by smooth, essentially jam-free operation of the elevator cup and firm, non-destructive holding of the lipstick pomade, many of the devices currently known in the art have achieved little or no success in solving the problems.

Noteworthy in the art of record is the lack of a cup drive mechanism that is truly balanced and symmetrical, and which prevents undesirable tilting or canting of the product-carrying cup and the lipstick carried therein.

In some prior constructions utilizing two diametrically disposed cam lugs, a reasonable degree of balance was attained. However, it can be readily seen that driving a cup solely at two diametrically opposite points, as has been done in the prior art, still does not prevent tilting of the cup about the transverse axis that contains the points. As a consequence, leaning or "wobbling" of the cosmetic stick carried in the cup tends to occur. Under some circumstances, the stick actually scrapes against the inner surface of the dispenser casing, causing damage to the otherwise smooth exterior surface of the stick, and resulting in an undesirable build-up of scraped product on the casing interior. If fragments or scrapings subsequently re-adhere to the stick, they can be carried outside the casing and dropped when the stick is next advanced, possibly leading to soiled or stained clothing, furniture, etc.

Various arrangements involving multiple, spring detent lugs on the outer surface of the product cup, as shown or suggested in some of the references noted above, have in some cases reduced the tendency for leaning or wobbling of the cup to occur. However, at present it is considered that there is still a need for improvement over known dispensers, from the standpoint of both economy and ease of operation.

SUMMARY OF THE INVENTION

Thus the above disadvantages and drawbacks of prior cosmetic dispensers are largely obviated, and the invention has for one object the provision of a novel and improved dispenser which is simple in its structure, reliable in operation, and which effectively non-destructively holds the pomade in the cup and also maintains axial alignment between the product-carrying cup and the casing as the cup and pomade stick carried thereby are advanced and retracted.

Still another object of the invention is to provide an improved cosmetic dispenser as above set forth, which virtually eliminates wobbling of the product-carrying cup and cosmetic stick, thereby reducing the possibility of scraping of the stick on the inner surface of the dispenser casing.

Yet another object of the invention is to provide an improved cosmetic dispenser of the kind indicated, which is resistant to binding and possible malfunction as a consequence of inadvertent de-railing of positioning lugs of the cup from corresponding longitudinal tracks or grooves in the dispenser casing.

Still another object of the invention is to provide an improved cosmetic dispenser as above characterized, which is economical to manufacture and assemble, thereby rendering the device commercially practical as to intended operativeness and economy in overall fabrication.

In accomplishing the above objects the invention provides a cosmetic dispenser comprising, in combination an elevator cup having improved means to carry a solid cosmetic product and an improved locking of the cup against axial removal, a sleeve in which the cup is axially advanceable and retractable, said sleeve having longitudinal slots and the elevator cup having lugs respectively passing through and projecting from the slots of the sleeve, and an operating shell turnably mounted on the sleeve, having internal spiral tracks engaged by the lugs of the cup to propel the latter in response to relative turning between the shell and sleeve.

The arrangement is such that the cup is advanced and retracted by balanced forces applied at uniformly spaced circumferential locations about the cup, and the pomade is precisely positioned in the cup against tilting or misalignment. The drive effects proper registration of the precisely-held cosmetic stick in the casing, and is effected by the respective engagement of the lugs at the circumferentially spaced locations with the walls of the spiral tracks. In addition, the combination comprises unique slide bearing surfaces, preferably at spaced locations between the lugs, to further stabilize the cup against inadvertent tilting, leaning or wobbling movements and the like.

Other features and advantages will hereinafter appear.

BRIEF DESCRIPTION OF THE DRAWINGS

In the drawings, illustrating several embodiments of the invention.

DESCRIPTION OF THE FIRST EMBODIMENT

Figure 1:
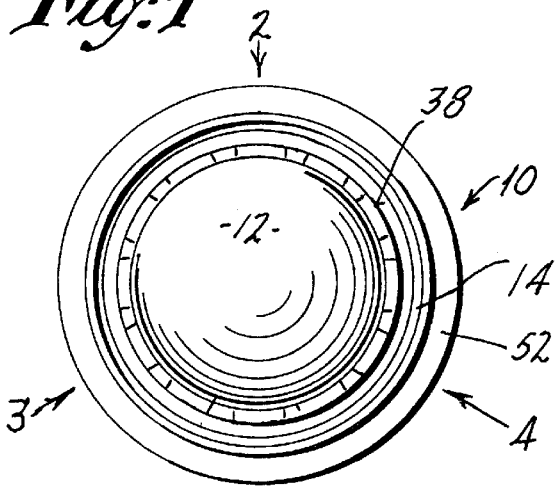
FIG. 1 is a top plan view of the improved cosmetic dispenser of the present invention with its cover removed, showing the slotted, cup-carrying or inner sleeve, the spiral operating shell or casing and the cosmetic stick product, such as a lipstick, carried within the inner shell.
Figure 2:
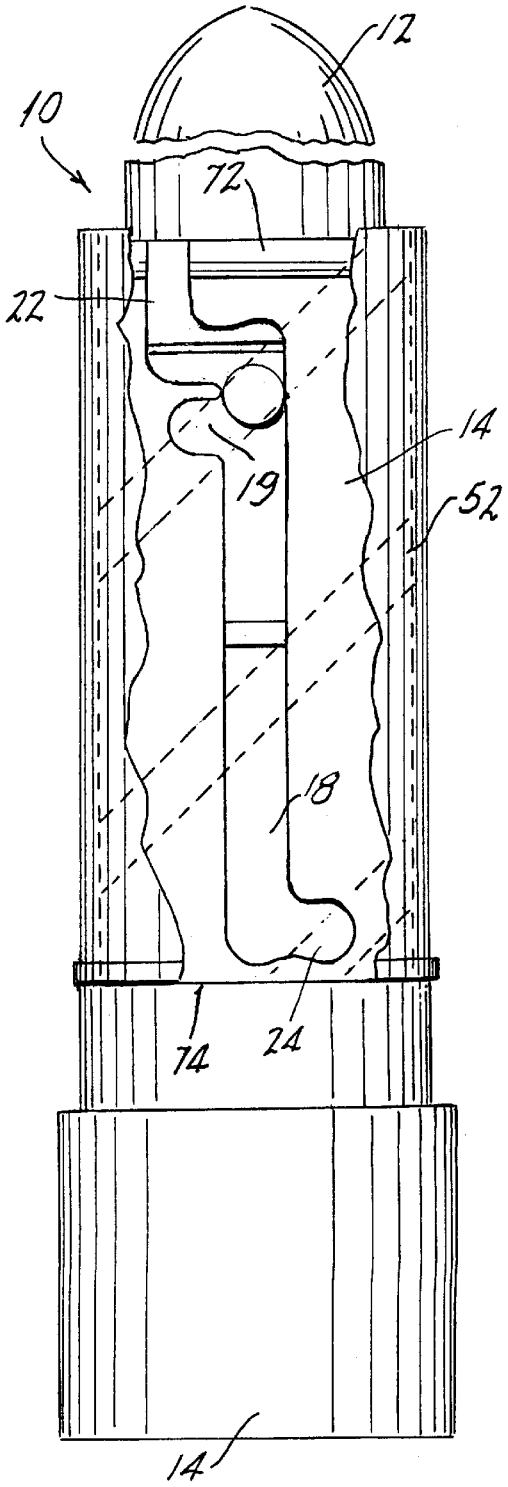
FIG. 2 is a side elevation of the dispenser, partly broken away, looking in the direction of the arrow "2" of FIG. 1.

Referring to FIGS. 1 and 2 and in accordance with the present invention there is provided a novel and improved cosmetic applicator or dispenser 10 for a stick product, such as a lipstick 12, comprising essentially three molded plastic components, an inner, substantially cylindrical sleeve having a slotted wall, an elevator cup that is slidable in the inner sleeve and which has radial projections extending through the slots in the sleeve, and a tubular manually-operable means in the form of an outer sleeve or spiral operating shell that is made to be open at both its opposite ends and is carried on the inner sleeve and turnable thereon.

In FIG. 2, the inner sleeve (often referred to in the trade as a slotted shell) is designated 14, and has a generally cylindrical shape. The sleeve has a slotted, resilient side wall, with three longitudinally extending slots or tracks 16, 18 and 20 (FIGS. 3, 2 and 4, respectively) that are, by the invention, disposed 120 degrees apart. The slot 18 has a pair of lateral or transverse passages 22, 24 at its ends, shown being of narrowed width with respect to the axial portion of the slot, the lateral passage 24 functioning to lock the elevator cup in a fully retracted position. The lateral passages of the slot 16 are designated 26 and 28, whereas those of the slot 20 are designated 30 and 32. As shown in FIG. 2, the slot 18 terminates at an opening 22 disposed at its upper end. and in FIGS. 3 and 4, the remaining two slots 16 and 20 respectively are open at their uppermost ends, at 34 and 36, respectively. The openings 22, 34, 36 enable portions of the cylindrical wall of the inner sleeve 14 adjacent the lip thereof to expand resiliently when the elevator cup is to be inserted into the sleeve during assembly, if this should be necessary.

We have discovered that by providing the open slots 16, 18 and 20 as such, only minimal, temporary and elastic deformation of the inner sleeve 14 is needed during such assembly, thereby facilitating the overall procedure and eliminating the possibility of inadvertent cracking of the inner sleeve 14 as a consequence of excessive stretching of the plastic thereof, beyond its elastic limit.

Figure 3:
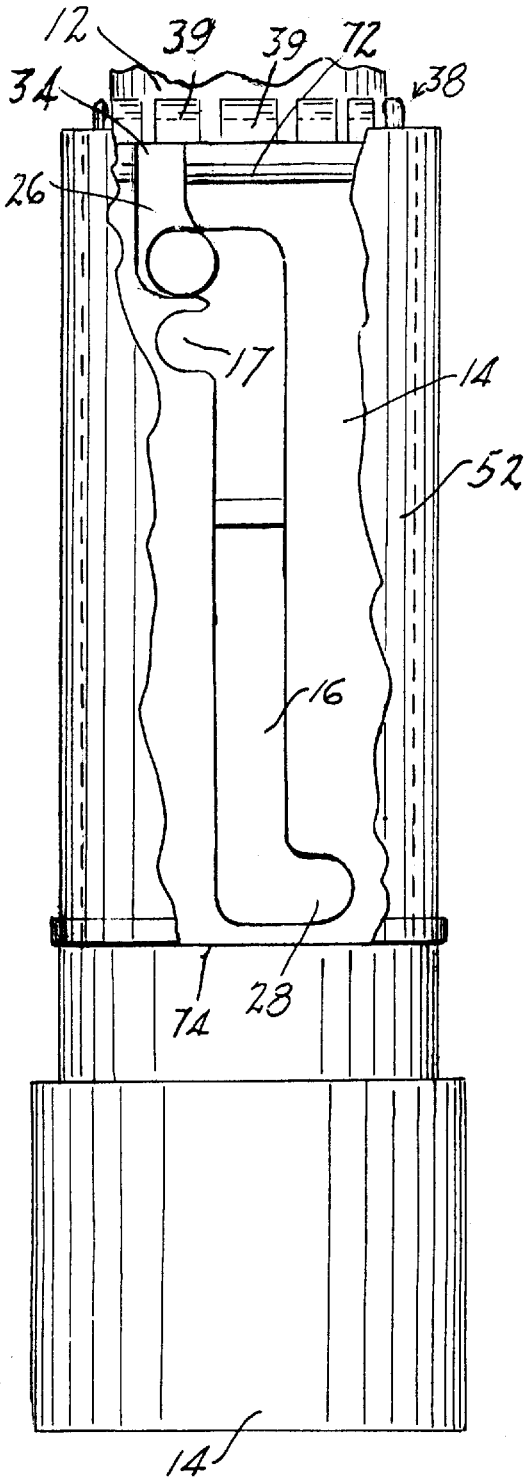
FIG. 3 is a side elevation, partly broken away, looking in the direction of the arrow "3" of FIG. 1. The elevator cup is disposed just short of being fully inserted into the casing assembly.
Figure 4:
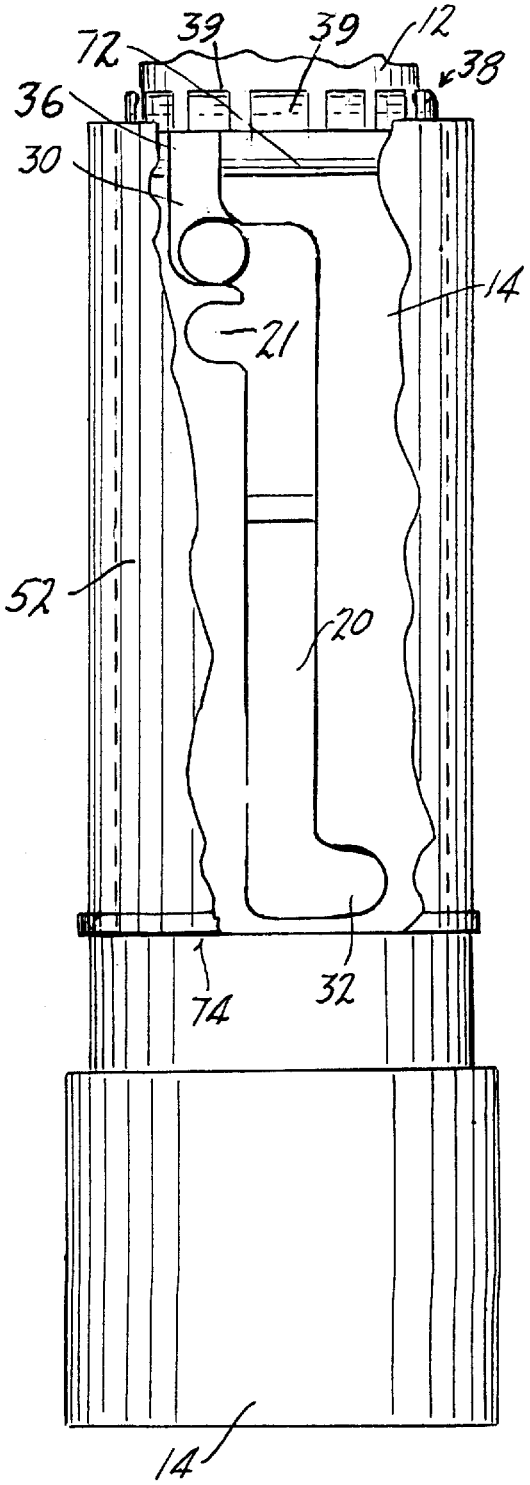
FIG. 4 is a side elevation partly broken away and similar to the view of FIG. 3 but looking in the direction of the arrow "4" of FIG. 1.
Figure 8:
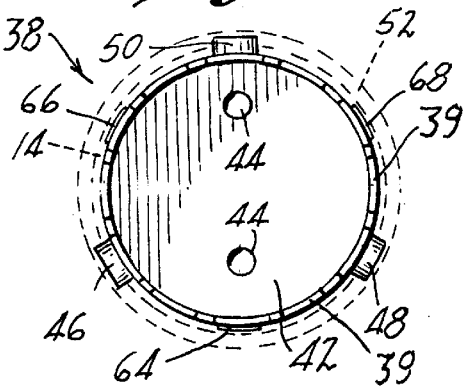
FIG. 8 is a top plan view of the elevator cup of the dispenser of FIG. 1.
Figure 10:
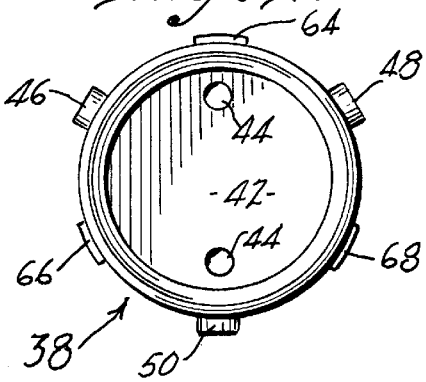
FIG. 10 is a bottom plan view of the elevator cup of FIGS. 8 and 9.
Figure 9:
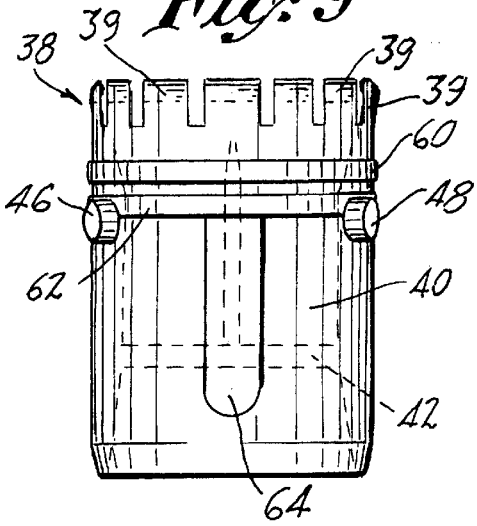
FIG. 9 is a side elevation of the elevator cup of FIG. 8.
Figure 11:
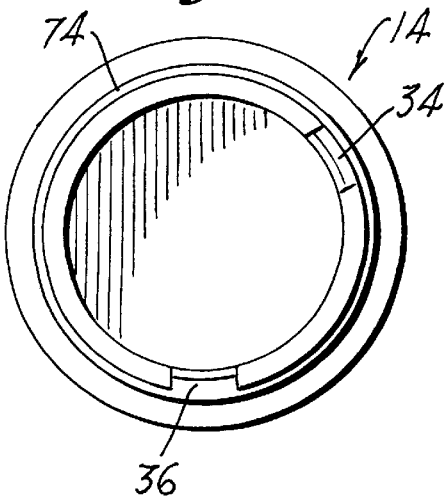
FIG. 11 is a top plan view of the slotted, cup-carrying sleeve of the dispenser of FIG. 1.

Referring now to FIGS. 8–10, the novel product-containing elevator cup of the invention is designated 38, and comprises a generally cylindrical side wall 40 and a transverse intermediate wall 42, preferably provided with one or more vent openings 44, to permit air to bleed therethrough when the molded cosmetic product is inserted into the cup interior. FIGS. 3 and 4 show the elevator cup 38 almost fully inserted in the casing assemblage of the lipstick.

Figure 13:
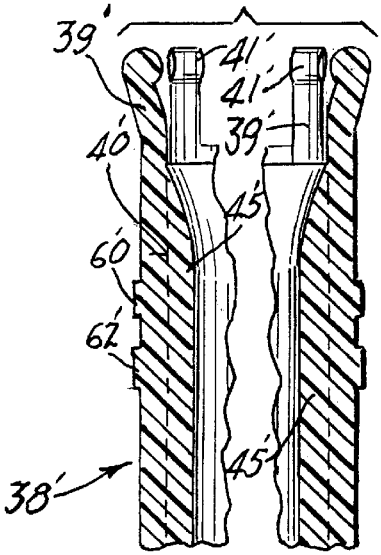
FIG. 13 is a fragmentary vertical axial section, enlarged, of the elevator cup per se illustrating another embodiment of the invention.

In a modification of the invention shown in FIG. 13 the inner surface of the side wall 40' of the cup 38' optionally has a plurality of low ribs or splines 45', preferably four in number, to retain or anchor the lipstick product in position mostly against turning in the cup 38'.

By the invention, the cup 38 is provided with three circumferentially equispaced follower lugs or trunnions 46, 48 and 50, FIG. 8, each disposed 120 degrees from one another, the lugs being adapted to respectively extend completely through the slots 16, 20 and 18 in the inner sleeve 14. The height of the lugs 46–50 is such that they project beyond the outer surface of the sleeve 14. During insertion of the cup 38 into the sleeve 14, the openings 22, 34 and 36 enable the wall portions of the sleeve adjacent to its lip to momentarily expand radially outwardly if necessary, within elastic limits, and thereafter to be restored to the positions indicated in the figures.

Figure 6:
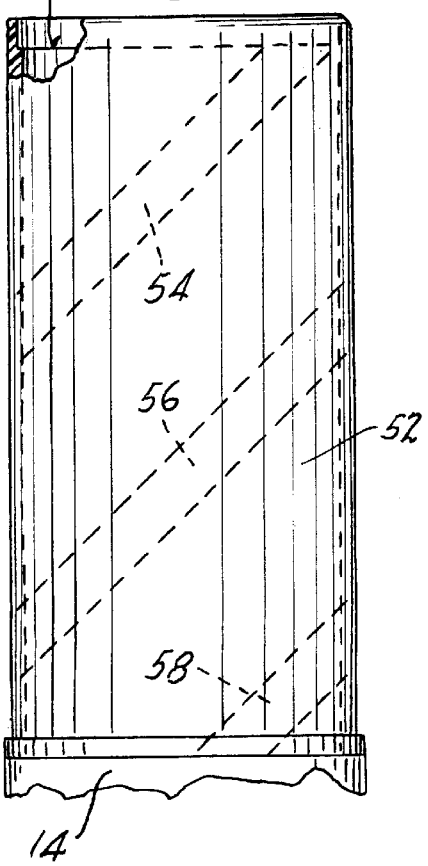
FIG. 6 is a view, partly in side elevation and partly in fragmentary section, of the assembly of the spiral operating shell of FIG. 5 and the inner sleeve or slotted shell.
Figure 5:
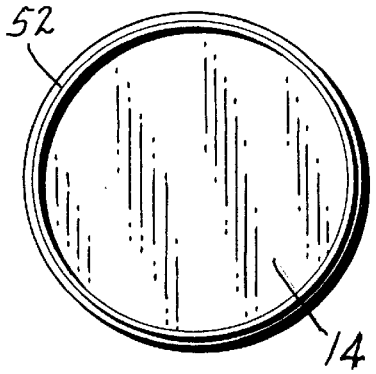
FIG. 5 is a top plan view of the assembly of the spiral operating shell or casing of the dispenser of FIG. 1, and the inner sleeve or slotted shell thereof.
Figure 7:
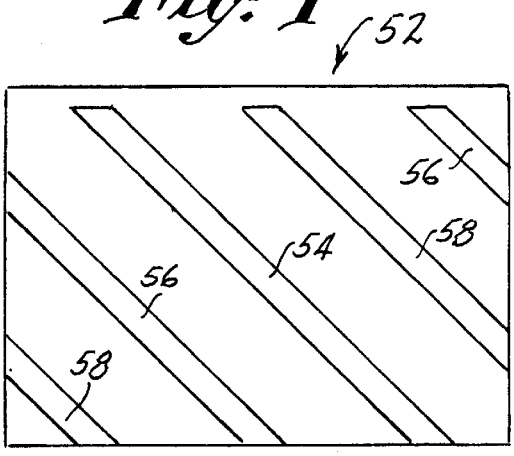
FIG. 7 is a development of the inner surface of the spiral operating shell of FIGS. 5 and 6, illustrating three separate, spiral grooves therein, which receive corresponding projections or lugs on the elevator cup that carries the cosmetic stick product.

Further by the invention, the outer open-ended sleeve or operating shell designated 52, FIGS. 5–7, (often known in the trade as a spiral shell) is provided with three separate and distinct, spiral or helical grooves 54, 56 and 58 in its inner surface, the grooves having a width sufficient to accommodate the lugs 46–50 respectively, and the lugs being sufficiently long to extend fully into the grooves 54-58, respectively, as in FIG. 8. By such an arrangement, turning of the operating shell 52 on the sleeve 14 can cause axial movement or travel of the cup 38 between a retracted position wherein the cup 38 is concealed in the sleeve 14 (not shown) and an advanced position wherein the cup 38 can approach the open end of the dispenser not quite as far as the initiation of insertion of the cup shown in FIGS. 2–4.

As will be explained below, the cup 38 is halted at a point in its advancing travel, being locked in a slightly lower position against being fully advanced and ejected, by a novel restraining or locking means that is described below.

We have found that by providing the three grooves 54, 56 and 58 in the operating shell 52, a highly desirable balanced precise force is applied to the cup 38 at three equidistant circumferentially spaced points, thereby avoiding any tendency for the lugs 46, 48 and 50 to become dislodged from the respective spiral grooves, and also minimizing wobble or tilting of the cup at any point. Such precise drive, in conjunction with an improved retention means for preventing full removal of the lipstick cup as more fully described below, results in a greatly improved overall dispensing product. The grooves 54, 56 and 58 are sufficiently deep and the lugs sufficiently long that, utilizing tolerances normally encountered in molding, a smooth, sliding fit occurs between the lugs and the walls of the respective spiral grooves.

Further by the invention, cooperable slide bearing means are provided on the outer surface of the cup 38 and on the sleeve 14, to further minimize possible wobbling or canting of the cup. The slide bearing means comprises the interior wall surface of the sleeve 14, and a pair of spaced-apart circumferential ring surfaces 60, 62 on the exterior of the cup 38, adapted for engagement with the interior wall surface of the sleeve 14.

In addition, supplemental bearing means are provided, in the form of three circumferentially spaced land surfaces or stabilizers 64, 66 and 68 on the exterior of the cup 38, these being engageable with the interior wall surface of the sleeve 14. The lands 64, 66 and 68 each straddle the wall 42 of the cup in an axial sense, extending from the one ring 62, which is axially above the wall 42, downwardly toward the lower end of the cup 38. It has been determined that with the provision of the rings 60, 62, and the three land surfaces 64, 66 and 68, as bearing surfaces, there results little or no tilting or canting of the cup 38 during normal operation of the cosmetic dispenser. This feature is considered especially important in conjunction with the improved pomade retention in the cup as described below, since the precisely-controlled cup carries the cosmetic pomade product or lipstick 12.

Considering the soft, waxy composition of lipsticks generally, it is important that the lipstick be axially aligned with the sleeve 14 and spaced uniformly from the side wall thereof, so as to not physically contact its inner surface. Such inadvertent contact might otherwise result in physical damage to the waxy stick material, as well as undesirable scraping of the waxy material by the inner surface, possibly creating wax fragments that could adhere to the stick, fall out of the casing and possibly soil skin, clothing, or other articles such as furniture, etc.

Further, by the invention and in addition to the three lugs 46, 48 and 50 being each 120 degrees apart from one another, preferably the land surfaces 64, 66 and 68 are also equispaced from one another, i.e. spaced 120 degrees apart. Each land surface can be spaced generally midway between the immediately adjacent lugs, thus being displaced circumferentially 60 degrees from such lugs. For example, in FIG. 8, the land surface 64 is disposed circumferentially between the lugs 46 and 48; the land surface 66 is disposed between the lugs 46 and 50; and the land surface 68 is disposed between the lugs 48 and 50.

As shown in FIG. 9, the rings 60, 62 are located such that the upper ring 60 is completely axially above the lugs 46, 48 and 50, whereas as noted above, the land surfaces 64, 66 and 68 extend a considerable distance from the location of the lower ring 62 toward the bottom of the cup 38, and thus have portions that extend axially below the location or plane of the lugs 46, 48 and 50, and also below the plane of the wall 42. It is considered that this combination of lugs, land surfaces, and bearing rings provides an optimum drive/positioning structure for the cup 38, to assure smooth, jam-free operation of the dispenser, at the same time contributing to proper retention of the stick product in an axially aligned position such that it cannot scrape against the side walls of the sleeve or casing 14.

In accordance with the present invention, the cup 38', as seen in FIG. 13, further has a plurality of resilient castellations or resilient fingers 39' having rounded tips and rounded inner surfaces 41' in its top rim, which have a special function, i.e. to securely anchor the lipstick in the cup without damaging its delicate physical make-up. Currently the widespread method of anchoring the lipstick utilizes prominent tapered ribs that dig into the cosmetic mass. This fractures the lipstick and in some cases causes small pieces to break away from the body of the lipstick. In more recent formulae, silicone-based lipsticks and those containing a certain quantity of hydrocarbon solvents and even water, result in a formulation that is not firmly held by the ribs, which bite into the product peripherally and vertically.

The invention, however, provides by means of the fingers 39', an effective clamping effect which holds the lipstick pomade tightly in the elevator cup 38' with a force that is at right angles to the forces which act to withdraw the lipstick from the cup. Preferably the walls of the cup are molded no heavier or thicker than 0.38 millimeters, and are generally constructed from polyoxymethylene plastic. The fingers 39' have a scalloped or castellated configuration which forms a collet of sorts. The tips of the castellations are formed as softly curved contours, and normally are molded to flange outward in annular orientation like the petals of a flower, as seen in FIG. 13, thereby to permit easy insertion of the lipstick into the cup. This orientation exists prior to the elevator cup 38 being fully inserted at the maximum propel position. The castellations 39 protrude beyond the limits of the slotted and spiral shells as seen in FIGS. 3 and 4.

After the lipstick is initially inserted into the cup 38, the cup is placed fully into the slotted shell 14. This causes the castellations 39 to experience a depressing force, and flexes them inward so as to press them into the lipstick in the manner of a horizontal ring or collet, penetrating the pomade mass preferably to a depth of approximately 0.64 millimeters. Optionally, as shown in the embodiment of FIG. 13, the cup 38 can be provided with low or slightly protruding internal ribs 45' which will penetrate the pomade to a restricted depth that does not fracture the pomade, the protrusion being shown exaggerated in FIG. 13. The embodiment of FIG. 13 employs both the castellations 39 and the ribs 45' to hold the lipstick, but the ribs 45' can be omitted since reliance can be placed entirely on the fingers 39', to securely anchor the pomade. With this latter arrangement the destructive effect of the ribs is eliminated and also the use of the fingers 39' provides for a far greater lead-in to facilitate lipstick insertion. FIG. 13 shows the fingers 39' as having the softly curved faces 41' that are engageable with the lipstick, to minimize damage thereto.

Figure 12:
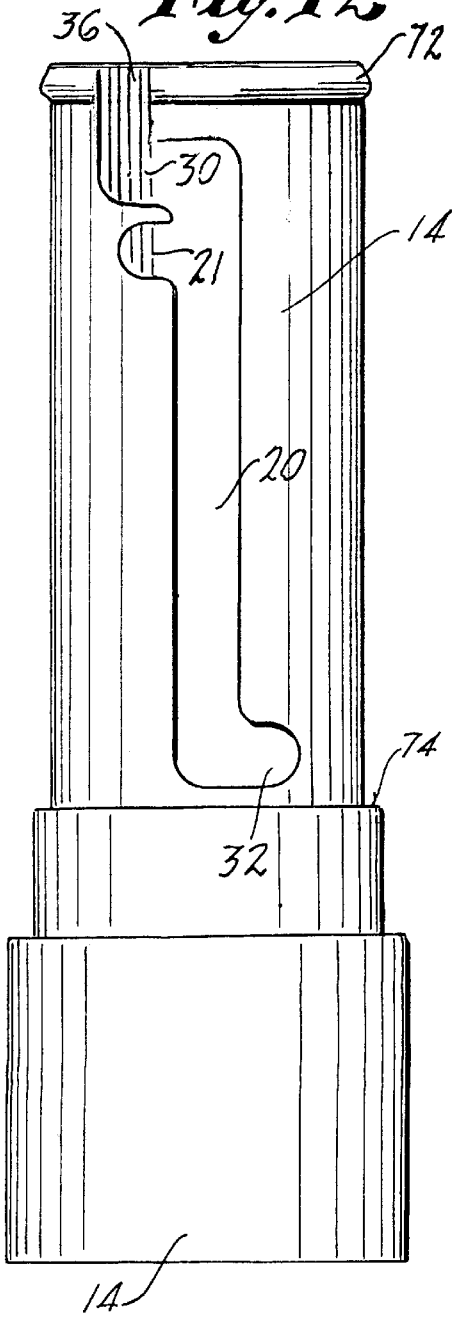
FIG. 12 is a side elevation of the inner sleeve of FIG. 11 and the base portion of the dispenser.

The invention further provides a novel, simple restraining means to halt the advancing travel and lock the cup 38, or 38' against withdrawal from the shell 14 once it has been inserted with the lipstick contained therein. As seen in FIG. 12, this means comprises a lateral locking stop shoulder or notch 21 comprising a lateral spur, so to speak, in the slot 20, and likewise additional locking notches 17 and 19 in the slots 16 and 18 respectively. The tracks 16, 18 and 20 are provided with these captivating transverse notches 17, 19 and 21 so that they will snag and entrap the follower pins 46, 48 and 50. In other words, when the elevator cup, after its first insertion in the sleeve 14, is shifted toward a protruding position, the trunnions 46, 48 and 50 will first become engaged with the locking notches 17, 19 and 21 and these will prevent further ejecting movement of the cup. Thus the fingers 39 or 39' will be kept in their inward positions wherein they securely retain the lipstick in the cup.

Referring to FIG. 6, the outer sleeve or operating shell 52 has an internal annular ledge 70 adjacent its lip, which fits beneath a circumferential bead 72, FIG. 12, on the outer surface of the shell 14, adjacent its lip. The bead is interrupted by the openings 34, 22 and 36 of the slots 16, 18 and 20 respectively. The outer sleeve 52 is thus retained by the engagement of the interrupted bead 72 with the annular ledge 70. During telescopic assembly of the outer sleeve 52 over the inner sleeve 14, the walls of the inner sleeve 14 adjacent its lip can collapse radially inwardly as permitted by the openings 34, 22 and 36 in the open slots 16, 18 and 20 respectively, to facilitate installation. When the outer sleeve 52 becomes seated on an annular shoulder 74 at the lower end of the sleeve, FIGS. 2–4 and 12, the resilience of the wall of the sleeve 14 restores its lip to its normal circular configuration, to thereby retain the outer sleeve 52.

In operation, after the insertion of the assembled cup 38 and sleeve 14 in the manually-operable operating shell 52, the latter is turned on the sleeve 14 and the walls of the grooves 54, 56 and 58 will apply a balanced drive force to the respective lugs 46, 48 and 50 simultaneously. The cup 38 can thus be advanced or retracted, as the lugs 46, 48 and 50 ride linearly in the respective grooves 16, 20 and 18. Locking in the extended position occurs when the lugs arrive at the transverse restraining notches 17, 19 and 21 and are forced laterally so as to be seated therein. Locking in a retracted position occurs when the lugs arrive at the notches 24, 28 and 32 and become seated therein. In the retracted position of the cup, each of the lugs becomes seated in its corresponding passage respectively, as can be readily understood.

Figure 14:
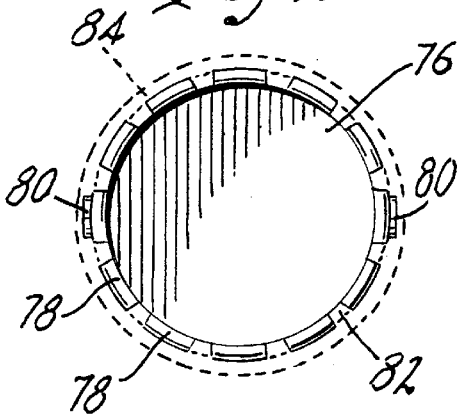
FIG. 14 is a top plan view of an elevator cup for a lipstick, illustrating another embodiment of the invention wherein the cup is adapted for use with a two-track shell and casing assemblage instead of a three track.

Another embodiment of the invention is illustrated in FIG. 14, which shows a top plan view of an elevator cup adapted for use with a two-track casing assemblage instead of a three-track assemblage. In this figure, the cup 76 has castellations 78 similar to the castellations 39 of the first embodiment, but in place of the three follower pins 46, 48 and 50 of the first embodiment is has only two follower pins 80, which are located diametrically opposite each other. The inner shell 14 shown in dotted outline has only two oppositely-disposed tracks (not shown) that are similar to the tracks 16, 18 and 20 of the first embodiment, and the outer shell or casing 84 has only two spiral grooves (also not shown) that are similar to the grooves 54, 56 and 58 of the first embodiment. In other respects, the two-track or slots embodiment of FIG. 14 is generally similar to the three-track embodiment already described above in detail, and the operation is likewise similar.

Figure 15:
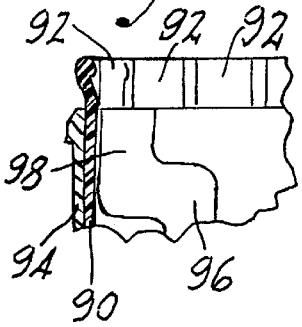
FIG. 15 is a fragmentary elevational and sectional view showing a portion of a modified open-top loading channel of one of the tracks of the slotted shell.

Still another embodiment of the invention is illustrated in FIG. 15, wherein a modified offset loading channel is provided, that enables an easy initial assembly of the elevator cup into the casing assemblage. In this figure the elevator cup 90 having the castellations 92 in its upper rim is shown as being carried by the inner shell 94 which has a loading channel 96. By this invention, the loading channel 96 is open at the top and has a laterally-offset open portion 98 at its top, that permits access to the channel by the follower pin of the cup.

The loading channel 96 of the inner shell does not have lateral transverse locking notches similar to those labelled 17, 19 or 21 in the respective tracks of the embodiment of FIG. 2, and thus the assembly of the elevator cup into the casing assemblage is simplified, as noted in the first sentence of this paragraph.

Figure 17:
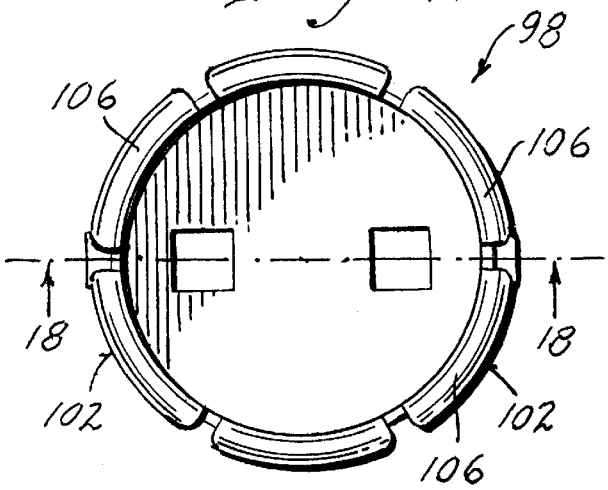
FIG. 17 is a top plan view of the shell of FIG. 16.
Figure 16:
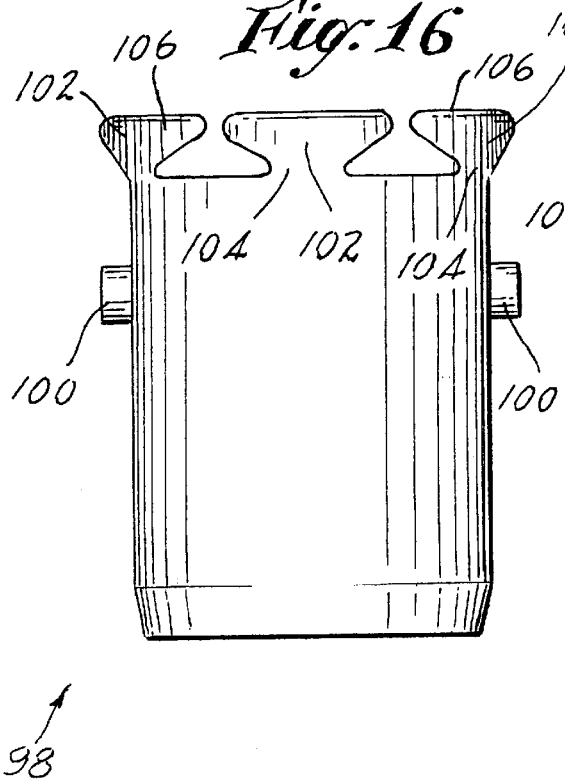
FIG. 16 is a side elevational view of an improved elevator cup for lipsticks and the like, illustrating yet another embodiment of the invention.
Figure 18:
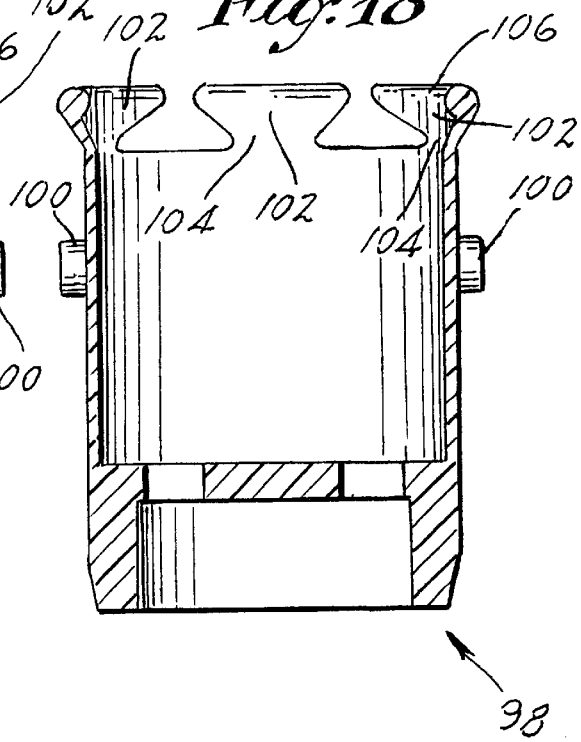
FIG. 18 is an axial sectional view of the cup, taken on the line 18—18 of FIG. 17.

Yet another embodiment of the invention is shown in FIGS. 16, 17 and 18. The cup 98 shown in these figures is of the type having two trunnions 100 and having a plurality of castellations or fingers 102 of trapezoidal configuration, with narrowed supporting base portions 104. The uppermost, free portions of the fingers 106 are curvilinear as seen in FIG. 17. In this embodiment all edges of the fingers 102 are well rounded to minimize the likelihood of interference with the spiral grooves of the outer sleeve 52 and the slots of the inner sleeve 14. The cup 98 has the advantages explained above in connection with the previous constructions.

Figure 19:
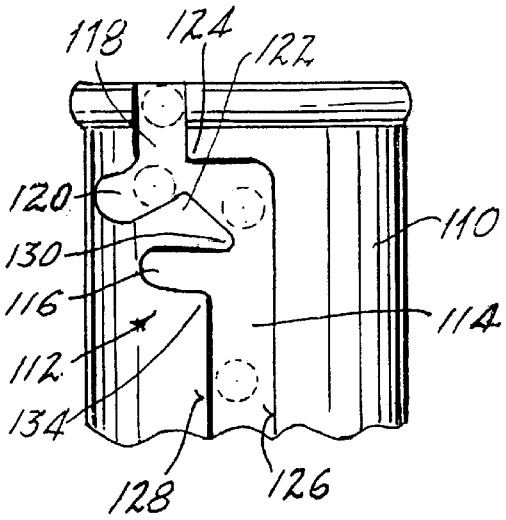
FIG. 19 is a fragmentary side elevation of a modified form of elevator cup, showing a constrictive section of the slots in the inner sleeve, to ensure against removal of the cup once it has been filled with the lipstick substance.

Another embodiment of the invention is illustrated in FIG. 19, wherein an inner sleeve 110 has been provided with a modified slot arrangement 112 which includes a vertical slot section 114, a back-check lateral or horizontal spur 116, an entry section 118 and a holding section or area 120. With this arrangement after the cup 76 is filled with the lipstick 12, (FIG. 2) the lugs 80 move counterclockwise as viewed in FIG. 14 and in response to relative turning of the outer sleeve 52, passing between the points 122 and 124 and thereafter between the point 134 and the slot edge 126 which respectively are spaced apart for a close resistance-fit with the lugs to resist retrograde movement of the latter. The cup 76 then continues to move downward with the lugs 80 being guided along the wall 126 until the lugs sit in the holding area at the lower end of the slot 114. The consecutive movements of the lugs 80 are indicated by the dotted circles in FIG. 19. For the reverse or upward movement of the cup and lugs, the latter move upward, hugging the wall 128 until the lugs 80 reach the holding or back-check spur 116. The point 130 ensures that the cup 76 does not pass upward beyond the spur 116.

Figure 22:
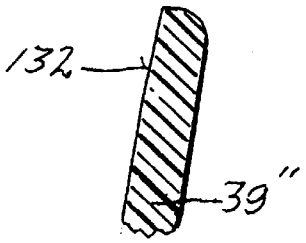
FIG. 22 is a fragmentary sectional view of a modified shape of resilient finger for the elevator cups of the invention.
Figure 20:
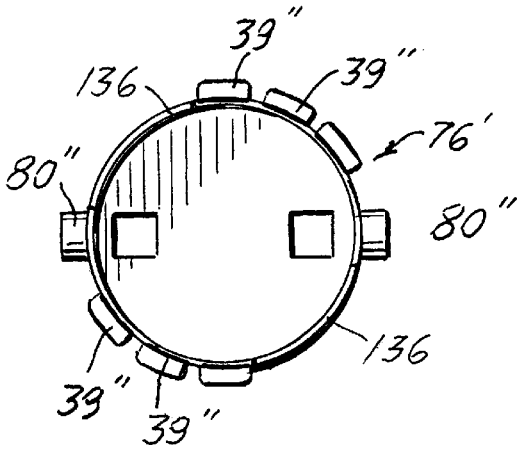
FIG. 20 is a top plan view of the elevator cup, showing a modified construction having two sets of resilient fingers with three fingers in each set.
Figure 21:
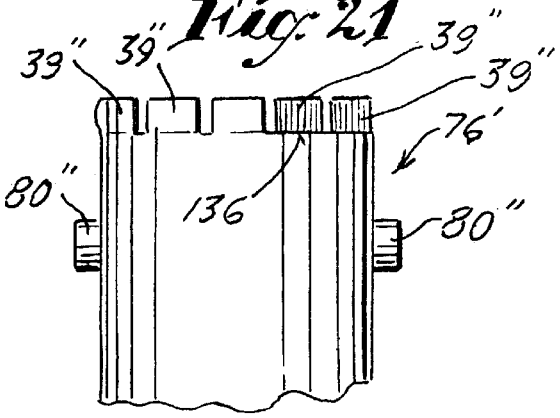
FIG. 21 is a fragmentary side elevational view of the cup of FIG. 20.

In FIGS. 20–22 a modified cup 76' is illustrated, having two oppositely-disposed sets of fingers or castellations 39", three in each set, these being so arranged as to avoid interference with the slots of the inner sleeve 14, where such sleeve is constituted for use with cups having two elevator lugs instead of three. The castellations 39" have flat inner sides 132 instead of the rounded inner sides of the lugs 39' shown in FIG. 13. An elevator cup with the lugs 39" is easier to mold than a cup with the fingers 39'. As shown, the cup 76' has two smooth top edges 136 which are respectively disposed between and below the top edges of the two sets of fingers or castellations 39".

From the above it can be seen that we have provided a novel and improved cosmetic dispenser which is reliable in operation and use, and which substantially eliminates the tendency for the cosmetic stick product to crack or be damaged and scrape against the inner surface of the dispenser casing all by virtue of the novel combination of balanced drive forces applied to three spaced locations (lugs 46, 48 and 50) of the elevator cup 38, and multiple bearing surfaces 60, 62, 64, 66 and 68 that are located on the exterior of the cup 38 and on the sleeve 14, the drive and bearing structures cooperating to largely eliminate potential problems with wobbling or tilting of the cup 38 and its cosmetic stick 12.

The parts of the herein-described dispenser can be readily assembled, rendering the dispenser compatible with high speed automated equipment. Substantially no inelastic deformation of the sleeves 14, 52 or cup 38 occurs by virtue of the open slot configuration of the sleeve 14; limited expansion of the wall thereof adjacent its lip can thus readily occur during installation of the cup in the sleeve. The same open slot configuration similarly permits retraction, in a radially inward direction, of the same wall of the sleeve 14 adjacent its lip, upon the outer sleeve 52 being telescopically applied over the inner sleeve 14. The disclosed device is thus seen to represent a distinct advance and improvement in the field of cosmetic dispensers.

Variations and modifications are possible without departing from the spirit of the invention.

Each and every one of the appended claims defines an aspect of the invention which is separate and distinct from all others, and accordingly it is intended that each claim be treated in this manner when examined in the light of the prior art devices in any determination of novelty or validity.

What I claimed is:

1. A cosmetic dispenser comprising, in combination:

a) an elevator cup having a top rim, said cup being adapted to receive and carry a solid cosmetic product, b) said cup having a plurality of resilient fingers extending along its top rim, c) an open-ended sleeve in which the cup can travel axially in advanceable and retractable directions, d) said fingers of the cup being adapted to engage cosmetic product in the cup, and to engage the inside of said sleeve to be forced inward thereby and into engagement with the cosmetic product therein, e) manually-operable means for causing said cup to travel in said sleeve toward the open end thereof, and f) restraining means for halting the advancing travel of the cup out of the sleeve, at a point in said travel wherein the said resilient fingers thereof still just experience the depressing force exerted on them by the sleeve.

2. A cosmetic dispenser as set forth in claim 1, wherein:

a) the open-ended sleeve has a longitudinal slot comprising a track, b) the cup has a follower lug which is received in the slot of the sleeve, and c) the restraining means comprises a stop shoulder on the sleeve, engageable with the follower lug on the cup to halt the travel of the latter.

3. A cosmetic dispenser as set forth in claim 2, wherein the said cup is molded of plastic substance.

4. A cosmetic dispenser as set forth in claim 2, wherein the stop shoulder on the sleeve comprises a lateral spur slot connected with the longitudinal slot of the sleeve.

5. A cosmetic dispenser as set forth in claim 4, wherein the sleeve has three slots and the cup has three followers engaged respectively with the said three slots.

6. A cosmetic dispenser as set forth in claim 5, wherein two of the three slots are open at their tops.

7. A cosmetic dispenser as set forth in claim 4, wherein the sleeve has two slots and the cup has two followers engaged respectively with the said two slots.

8. A cosmetic dispenser as set forth in claim 7, wherein a) said two slots are open at their tops, and b) the openings of said two slots are offset laterally from the remainders of the slots.

9. A cosmetic dispenser as set forth in claim 7, wherein the elevator cup has two sets of oppositely-disposed fingers, each set comprising a plurality of fingers and each set being disposed to avoid interference with the slots of the inner sleeve as the cup is being raised and lowered.

10. A cosmetic dispenser as set forth in claim 9, wherein the elevator cup has two smooth top edges disposed respectively between and below the top edges of the said two sets of fingers.

11. A cosmetic dispenser as set forth in claim 4 wherein the longitudinal slot of the open-ended sleeve has a constriction disposed above the said lateral spur slot, which is operable to minimize the likelihood of the elevator cup moving upward out of the open-ended sleeve.

12. A cosmetic dispenser as set forth in claim 2, wherein the longitudinal slot of the sleeve is open at the top of the sleeve to admit insertion of the cup in the sleeve top.

13. A cosmetic dispenser as set forth in claim 12, wherein the opening of the longitudinal slot at the top thereof is offset laterally from the remainder of the slot.

14. A cosmetic dispenser as set forth in claim 1, wherein the resilient fingers are rounded at their tips to avoid cutting into the cosmetic product.

15. A cosmetic dispenser as set forth in claim 14, wherein the resilient fingers have flat inner sides to facilitate the molding of the cup.

16. A cosmetic dispenser as set forth in claim 14, wherein the rounded tips of the said fingers have rounded inner surfaces which are engageable with the cosmetic product.

17. A cosmetic dispenser as set forth in claim 1 wherein said fingers have a trapezoidal configuration.

* * * * *